US005839563A

United States Patent [19]

Takahashi

[11] Patent Number: 5,839,563

[45] Date of Patent: Nov. 24, 1998

[54] COIN DISCRIMINATING APPARATUS

[75] Inventor: Masataka Takahashi, Matsudo, Japan

[73] Assignee: Laurel Bank Machines Co., Ltd., Tokyo, Japan

[21] Appl. No.: 820,413

[22] Filed: Mar. 12, 1997

[30] Foreign Application Priority Data

Mar. 28, 1996 [JP] Japan ..... 8-074900
Feb. 21, 1997 [JP] Japan ..... 9-37838

[51] Int. Cl.[6] ..... G07D 5/10

[52] U.S. Cl. ..... 194/328; 194/331; 194/335

[58] Field of Search ..... 194/317, 328, 194/331, 334, 335

[56] References Cited

U.S. PATENT DOCUMENTS

| | | | |
|---|---|---|---|
| 4,089,400 | 5/1978 | Gregory | 194/331 X |
| 5,236,074 | 8/1993 | Gotaas | 194/328 X |
| 5,494,147 | 2/1996 | Takaashi et al. | 194/328 |
| 5,515,960 | 5/1996 | Wood | 194/328 |
| 5,538,123 | 7/1996 | Tsuji | 194/328 X |

FOREIGN PATENT DOCUMENTS

| | | | |
|---|---|---|---|
| 5-46840 | 2/1993 | Japan | 194/328 |
| 7-10875 | 4/1995 | Japan . | |
| 7-110875 | 5/1995 | Japan . | |
| 7-129807 | 5/1995 | Japan . | |

*Primary Examiner*—F. J. Bartuska
*Attorney, Agent, or Firm*—Frishauf, Holtz, Goodman, Langer & Chick, P.C.

[57] ABSTRACT

A coin discriminating apparatus includes a plurality of light emitting elements, an area sensor for optically detecting light reflected by the coin and producing pattern data of the coin, a mirror member provided on one side portion of the coin along the coin passage at a predetermined angle with an axis of the coin for reflecting light reflected from a side surface of the coin and leading the light to the area sensor, and a coin discriminator for discriminating the coin based on first pattern data produced by detecting light reflected from a lower surface of the coin and second pattern data produced by detecting light reflected by the side surface of the coin. According to the thus constituted coin discriminating apparatus, it is possible to discriminate coins by optically detecting the pattern of the obverse or reverse surface and the side surface of a coin with simple structure and with high accuracy.

18 Claims, 10 Drawing Sheets

COIN DISCRIMINATING APPARATUS

BACKGROUND OF THE INVENTION

The present invention relates to a coin discriminating apparatus and, in particular, to a coin discriminating apparatus for discriminating coins by optically detecting coin lower and side surfaces patterns.

DESCRIPTION OF THE PRIOR ART

U.S. Pat. No. 5,494,147 discloses a coin discriminating apparatus for discriminating the denomination of a coin, its genuineness and whether or not it is a foreign coin by the steps of mapping pattern data produced by optically detecting an obverse or reverse surface of the coin in a x-y coordinate system, tentatively determining a coin denomination based on the diameter of the coin, transforming the pattern data into a polar coordinate system, and comparing the transformed pattern data with reference data of a coin of the tentatively determined denomination.

Further, Japanese Patent Application Laid-Open No. 7-129807 discloses a coin discriminating apparatus for discriminating the denomination of a coin, its genuineness of a coin and whether or not it is a foreign coin based on the pattern of the side surface of the coin obtained by irradiating the side surface of the coin with light and detecting light reflected from the side surface of the coin.

However, since the coin discriminating apparatus disclosed in U.S. Pat. No. 5,494,147 discriminates the denomination of a coin, its genuineness and whether or not it is a foreign coin based on the pattern of the obverse or reverse surface of the coin, if the pattern of the obverse or reverse surface of the coin coincides with that of a genuine coin, even if the thickness or the pattern of the side surface of the coin is different from that of a genuine coin, the coin is necessarily discriminated to be a genuine coin and, therefore, it is impossible to discriminate a counterfeit coin which is different only in thickness, the pattern of the side surface or the like.

Further, since the coin discriminating apparatus disclosed in Japanese Patent Application Laid-Open No. 7-129807 discriminates the denomination of a coin, its genuineness and whether or not it is a foreign coin based on only the pattern of the side surface of the coin, even if the pattern of the obverse or reverse surface of the coin is different, the coin is without fail discriminated to be a genuine coin and, therefore, the discrimination accuracy is low.

However, although the discrimination accuracy can be improved, in the case where both a coin discriminating means for discriminating the denomination of a coin, its genuineness and whether or not it is a foreign coin based on the pattern of the obverse or reverse surface of the coin and a coin discriminating means for discriminating the denomination of a coin, its genuineness and whether or not it is a foreign coin based on the thickness or the pattern of the side surface of a coin are provided, the coin discriminating apparatus inevitably becomes large.

SUMMARY OF THE INVENTION

It is therefore an object of the present invention to provide a compact coin discriminating apparatus capable of discriminating coins by optically detecting the pattern of the obverse or reverse surface and the side surface of a coin with simple structure and with high accuracy.

The above and other objects of the present invention can be accomplished by a coin discriminating apparatus comprising irradiating means for projecting light onto a coin, light receiving means for optically detecting light reflected by the coin and producing pattern data of the coin, a mirror member provided on one side portion of the coin along the coin passage at a predetermined angle with an axis of the coin for reflecting light reflected from a side surface of the coin and leading the light to the light receiving means, and a coin discriminating means for discriminating the coin based on first pattern data produced by detecting light reflected from a lower surface of the coin and second pattern data produced by detecting light reflected by the side surface of the coin.

The above and other objects can be also accomplished by a coin discriminating apparatus comprising irradiating means for projecting light onto a coin, light receiving means for optically detecting light reflected by the coin and producing pattern data of the coin, a pair of mirror members provided on both side portions of the coin along the coin passage at predetermined angles with an axis of the coin for reflecting light reflected from a side surface of the coin and leading the light to the light receiving means, and a coin discriminating means for discriminating the coin based on first pattern data produced by detecting light reflected from a lower surface of the coin and second pattern data produced by detecting light reflected by the side surface of the coin.

The above and other objects can be further accomplished by a coin discriminating apparatus comprising irradiating means for projecting light onto a coin, light receiving means for optically detecting light reflected by the coin and producing pattern data of the coin, at least three mirror members provided on side portions of the coin above the coin passage at predetermined angles with an axis of the coin for reflecting light reflected from a side surface of the coin and leading the light to the light receiving means, and a coin discriminating means for discriminating the coin based on first pattern data produced by detecting light reflected from a lower surface of the coin and second pattern data produced by detecting light reflected by the side surface of the coin.

In a preferred aspect of the present invention, the coin discriminating means comprises first coin discriminating means for discriminating a coin based on the first pattern data produced by detecting light reflected from the lower surface of the coin, second coin discriminating means for discriminating the coin based on the second pattern data produced by detecting light reflected by the side surface of the coin, and third coin discriminating means for discriminating the coin to be an unacceptable coin when the results of the discrimination by the first coin discriminating means and the second coin discriminating means does not agree with each other and discriminating the coin to be a genuine coin of a denomination discriminated by the first coin discriminating means and the second coin discriminating means when the results of the discrimination by the first coin discriminating means and the second coin discriminating means agree with each other.

In a further preferred aspect of the present invention, the second coin discriminating means is constituted so as to discriminate a coin further from thickness of the coin calculated based on the second pattern data.

In a further preferred aspect of the present invention, the irradiating means comprises light emitting means for emitting light and light directing means for uniformly directing light emitted from the light emitting means onto the surface of the coin at a shallow angle.

The above and other objects and features of the present invention will become apparent from the following description made with reference to the accompanying drawings.

DESCRIPTION OF THE PREFERRED EMBODIMENTS

Figure 1:
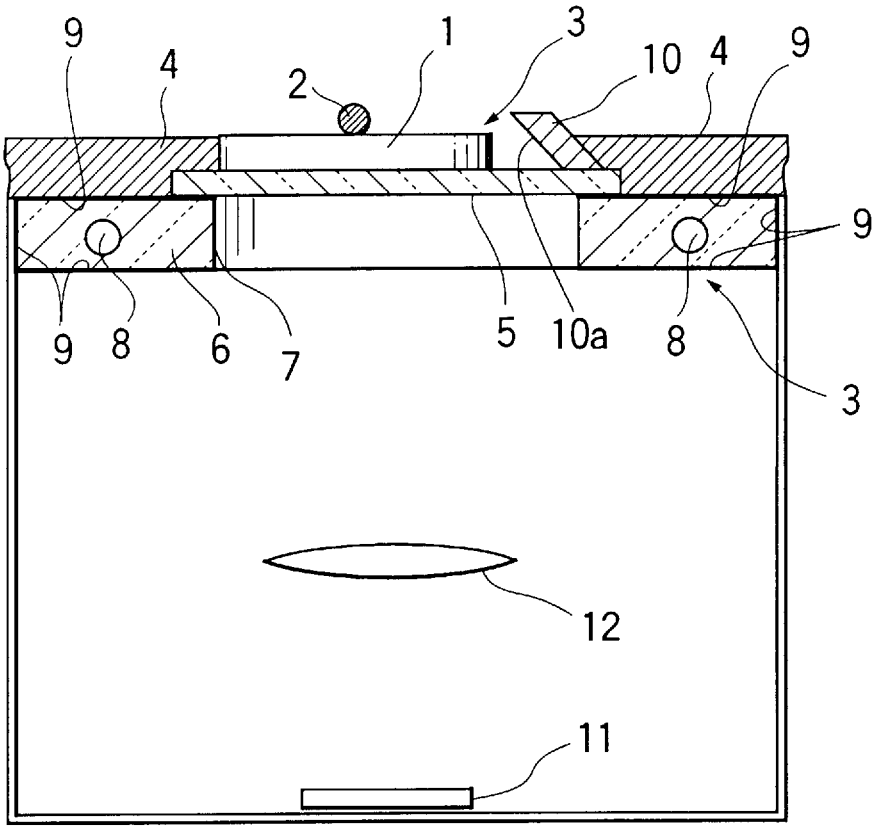
FIG. 1 is a schematic cross sectional view of a coin discriminating portion of a coin discriminating apparatus which is an embodiment of the present invention.
Figure 2:
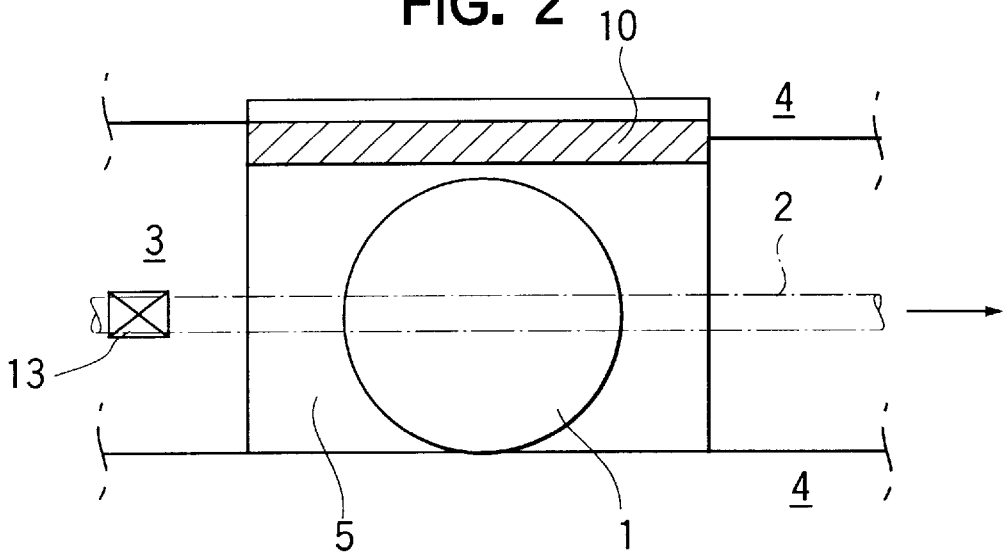
FIG. 2 is a schematic plan view of a coin discriminating portion of a coin discriminating apparatus which is an embodiment of the present invention.

As shown in FIGS. 1 and 2, a coin 1 is pressed onto the surface of a coin passage 3 by an endless belt 2 and fed in the coin passage 3 along a pair of guide rails 4 in the direction perpendicular to a paper in FIG. 1 and the direction indicated by an arrow in FIG. 2. A part of the coin passage 3 is formed with a transparent member 5 made of glass, acrylic resin or the like through which light can transmit and a support plate 6 is provided for supporting the coin passage 3 in such a manner that it contacts the lower surface of the coin passage 3. The support plate 6 is formed with a transparent plate made of glass, acrylic resin or the like through which light can transmit. The support plate 6 below the transparent member 5 is formed with a hole 7 greater than the largest coin to be discriminated and equal to the distance between the pair of guide rails 4. The transparent member 5 is arranged so as to cover the hole 7.

Figure 3:
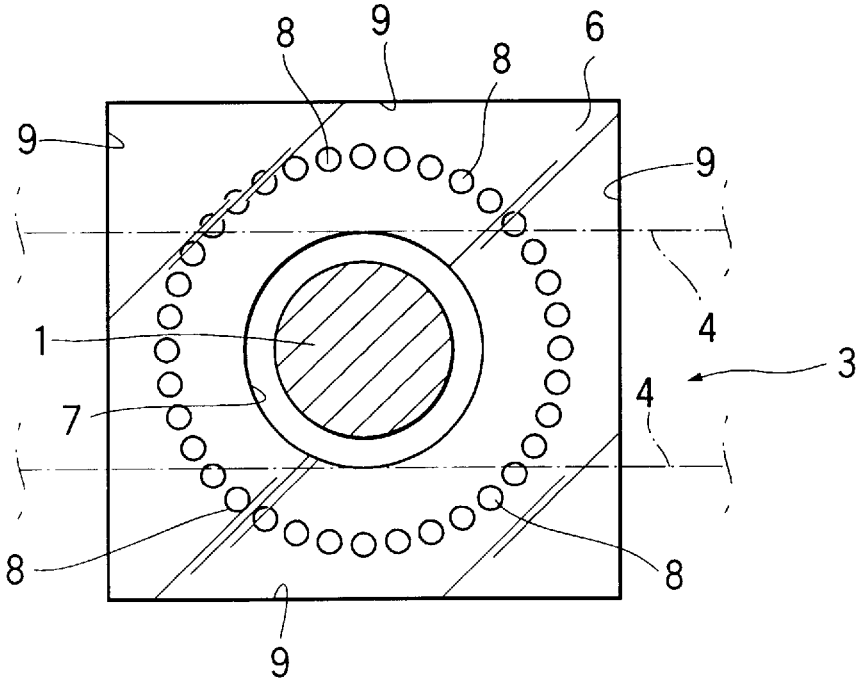
FIG. 3 is a schematic lateral cross sectional view showing a support plate.

FIG. 3 is a schematic lateral cross sectional view showing the support plate 6.

As shown in FIG. 3, a plurality of light emitting elements 8 are annularly arranged in the support plate 6 and reflection members 9 made of aluminum foil or the like are provided on the inner surfaces of side portions and upper and lower inner surfaces of the support plate 6. The hole 7 of the support plate 6 is formed by grinding.

As shown in FIGS. 1 and 2, a mirror 10 is provided along the guide rails 4 so as to face the side surface of the coin 1 transported in the coin passage 3. The mirror 10 has a plate-like shape whose length in the coin transport direction is longer than the diameter of the greatest coin to be discriminated and the reflecting surface 10*a* of the mirror 10 is arranged at a predetermined angle, for example, 45 degrees, with the axis of the coin 1 so as to lead light reflected from the side surface of the coin 1 downwardly in FIG. 1.

As shown in FIG. 1, an area sensor 11 is provided below the hole 7 and a convex lens 12 is provided between the hole 7 and the area sensor 11 for converging light reflected from the coin 1 into the area sensor 11.

Light emitted from the plurality of light emitting elements 8 is repeatedly reflected by the reflection members 9 provided on the inner surfaces of side portions and upper and lower inner surfaces of the support plate 6 so as to become uniform before entering the hole 7. Since the direction of incident light is uniform and the positional relationship between the hole 7 and the coin 1 is determined as shown in FIGS. 1 to 3, light is projected onto the lower surface of the coin 1 at a shallow angle with respect to the lower surface of the coin 1.

Light projected onto and reflected by the lower surface of the coin 1 is converged by the convex lens 12 and enters an area sensor 11.

On the other hand, the pattern of the light reflected from the side surface of the coin 1 that impinges on the reflecting surface 10*a* of the mirror 10 is reflected by the reflecting surface 10*a* of the mirror 10 and is directed to the area sensor 11.

As shown in FIG. 2, a coin sensor 13 is provided at a portion of the coin passage 3 upstream of the support plate 6 for outputting a coin detection signal to the area sensor 11 when it detects the coin 1 so that the area sensor 11 can produce pattern data of the coin 1 based upon only light reflected by the lower surface of the coin 1 located at a predetermined position above the hole 7.

Figure 4:
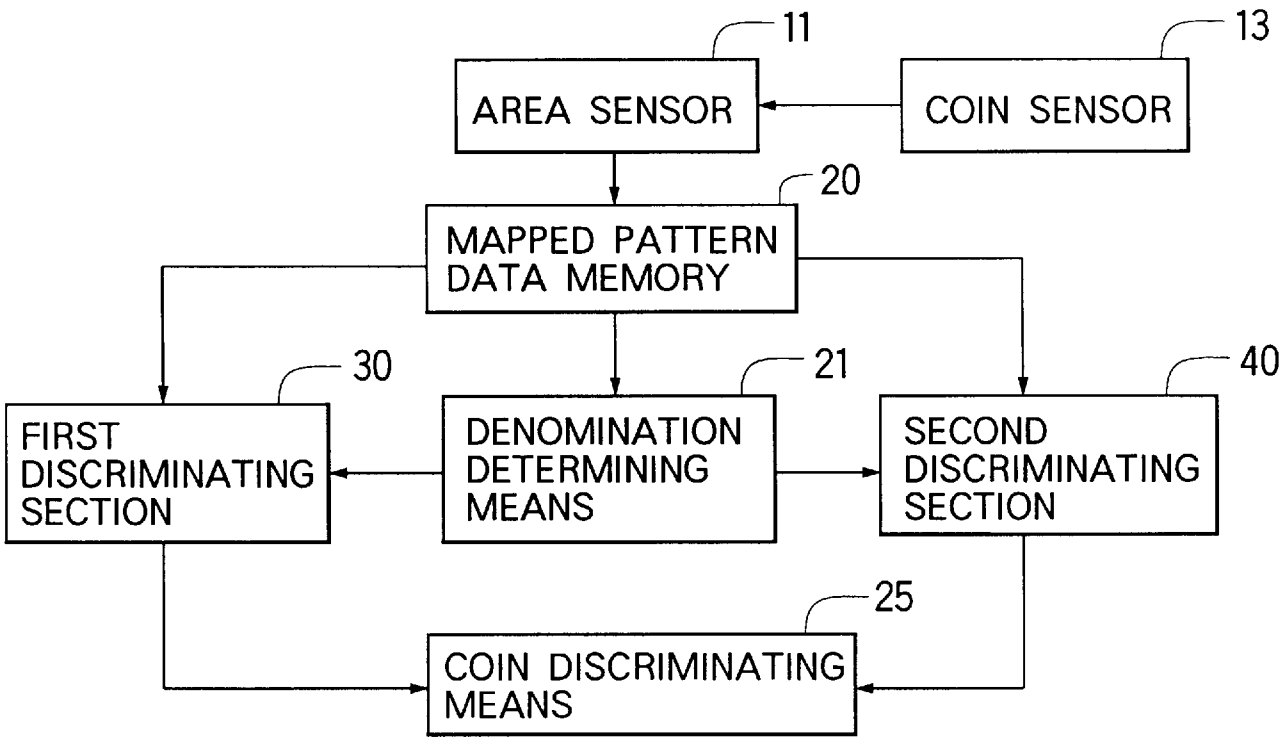
FIG. 4 is a block diagram of detection and discrimination systems of a coin discriminating apparatus which is an embodiment of the present invention.

FIG. 4 is a block diagram of the detection and discrimination systems of a coin discriminating apparatus which is an embodiment of the present invention.

As shown in FIG. 4, the detection and discrimination systems of a coin discriminating apparatus which is an embodiment of the present invention include the area sensor 11 for detecting the surface pattern of the coin 1 at a predetermined timing based on the coin detection signal from the coin sensor 13 and producing pattern data of the lower and side surfaces of the coin 1, a mapped pattern data memory 20 for storing the pattern data of the coin 1 produced by the area sensor 11 as mapped into a rectangular coordinate system, namely, an x-y coordinate system, denomination determining means 21 for tentatively determining the denomination of the coin 1 based on the pattern data of the lower surface of the coin 1 mapped and stored in the mapped pattern data memory 20 and outputting denomination signals, a first discriminating section 30 for discriminating the denomination of the coin 1, its genuineness and whether or not it is a foreign coin based on the pattern data of the lower surface of the coin 1 mapped and stored in the mapped pattern data memory 20, a second discriminating section 40 for discriminating the denomination of the coin 1, its genuineness and whether or not it is a foreign coin based on the pattern data of the side surface of the coin 1 mapped and stored in the mapped pattern data memory 20, and coin discriminating means 25 for discriminating the denomination of the coin 1, its genuineness and whether or not it is a foreign coin based on the results of discrimination made by the first discriminating section 30 and the second discriminating section 40.

Figure 5:
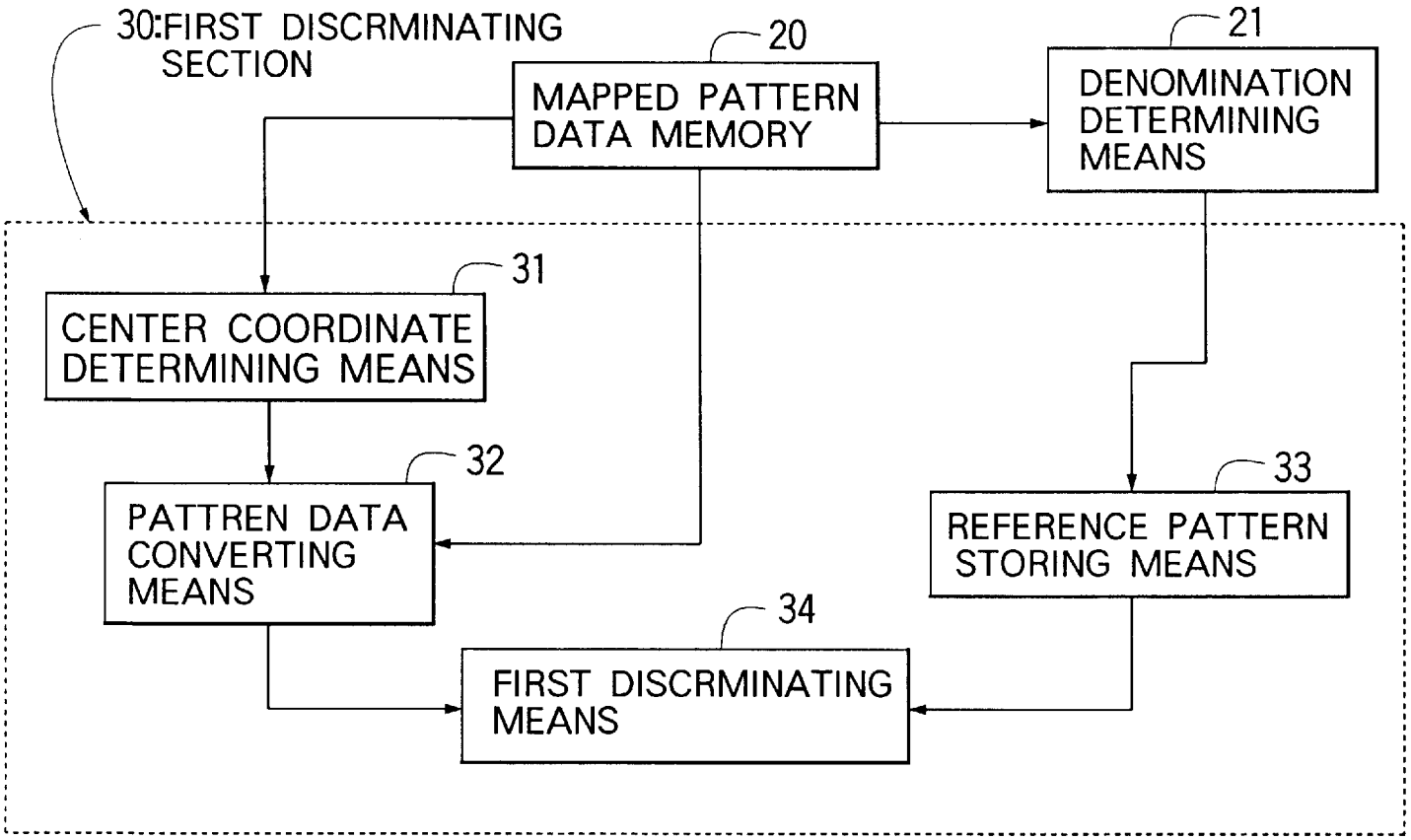
FIG. 5 is a block diagram of a first discriminating section.

FIG. 5 is a block diagram of the first discriminating section 30.

As shown in FIG. 5, the first discriminating section 30 includes center coordinate determining means 31 for determining the center coordinates of the pattern data of the lower surface of the coin 1 mapped and stored in the mapped pattern data memory 20, pattern data converting means 32 for transforming the pattern data into a polar coordinate system, namely, an r-θ coordinate system based on the center coordinate of the pattern data determined by the center coordinate determining means 31, reference pattern data storing means 33 for storing reference pattern data of the lower surface for each denomination of coin 1 and first discriminating means 34 for comparing converted pattern data transformed into the r-θ coordinate system by the pattern data converting means 32 with the reference pattern data stored in the reference pattern data storing means 33 and discriminating the denomination of the coin 1, its genuineness and whether or not it is a foreign coin.

Figure 6:
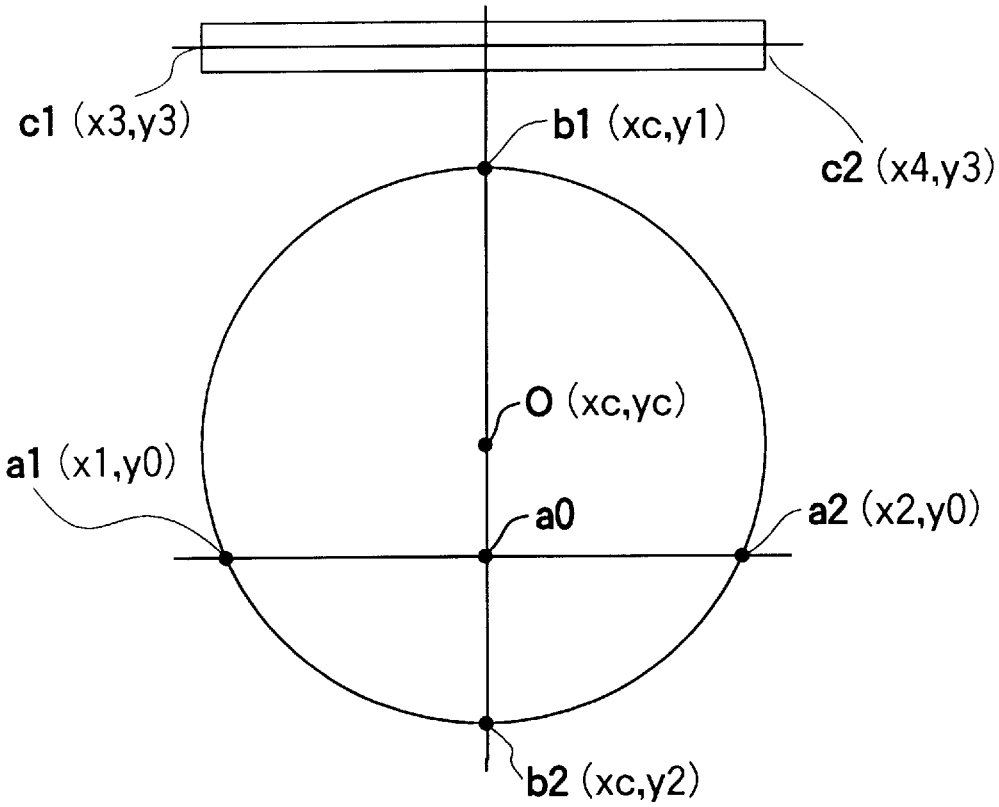
FIG. 6 is a schematic view showing a method for calculating the center coordinate of pattern data effected by center coordinate calculating means.

FIG. 6 is a schematic view showing a method for determining the center coordinate of pattern data effected by center coordinate determining means 31.

As shown in FIG. 6, the pattern data of the lower and side surfaces of the coin 1 produced by the area sensor 11 are mapped in the x-y coordinate system and stored in the mapped pattern data memory 20. The center coordinate determining means 31 determines x-coordinates x1 and x2 of boundary data a1 and a2 whose y-coordinate is y0 of the pattern data of the lower surface of the coin 1 mapped and stored in the mapped pattern data memory 20 and determines an x-coordinate xc=(x1+x2)/2 of a center data a0 between the boundary data a1 and a2. Then, the center coordinate determining means 31 draws an imaginary straight line from the data a0 perpendicular to a straight line extending through the boundary data a1 and a2 to determine y-coordinates y1 and y2 of boundary data b1 and b2 which correspond to the points of intersection of the imaginary straight line and the boundary of the pattern data and determines a y-coordinate yc=(y1+y2)/2 of center data O between the boundary data b1 and b2. The thus determined coordinates (xc, yc) of the data O corresponds to the center coordinate of the pattern data of the lower surface of the coin 1 mapped in the x-y coordinate system and the data O corresponds to the data center of the pattern data of the lower surface of the coin 1 mapped in the x-y coordinate system.

Figure 7:
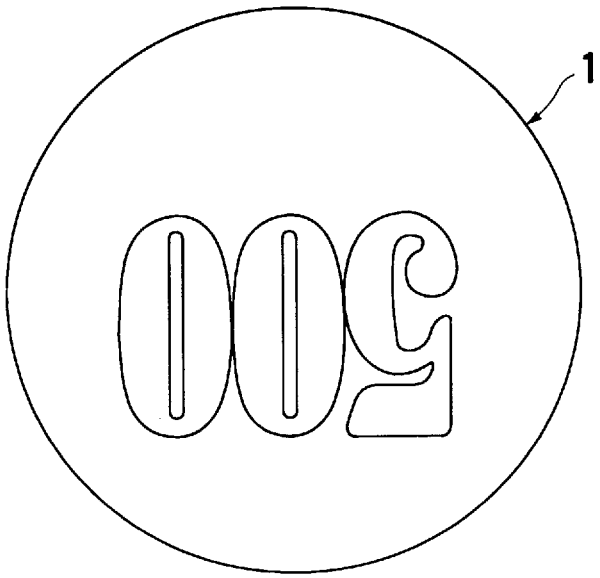
FIG. 7 is a view showing one example of pattern data of a coin produced by an area sensor and mapped and stored in a mapped pattern data memory.
Figure 8:
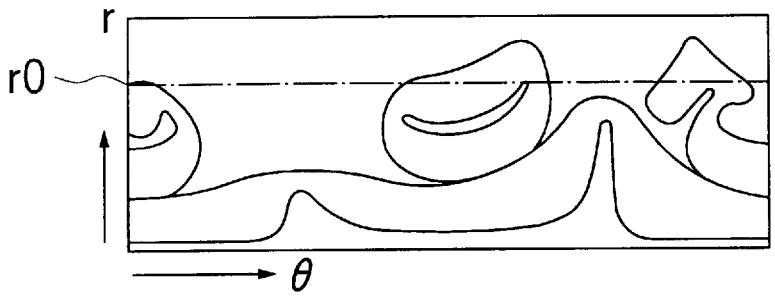
FIG. 8 is a view showing converted pattern data produced by transforming the pattern data shown in FIG. 7 into a polar coordinate system by pattern data converting means and stored in the pattern data converting means.

FIG. 7 shows one example of pattern data of the lower surface of a coin 1 produced by the area sensor 11 and mapped and stored in the mapped pattern data memory 20 and FIG. 8 shows converted pattern data produced in the pattern data converting means 32 by transforming the pattern data shown in FIG. 7 into an r-θ coordinate system based upon the center coordinate (xc, yc) of the pattern data of the lower surface of the coin 1 determined by the center coordinate determining means 31. In FIG. 8, the ordinate represents the distance r from the data center O in the x-y coordinate system and the abscissa represents an angle θ about the data center O.

The converted pattern data of the lower surface of the coin 1 transformed into the r-θ coordinate system by the pattern data converting means 32 in this manner are input to the first discriminating means 34. On the other hand, a denomination signal produced by the denomination determining means 21 is input to the reference pattern data storing means 33. In response, the reference pattern data storing means 33 selects the reference pattern data of the reverse surface of the coin 1 of the denomination corresponding to the denomination signal from among the reference pattern data of obverse and reverse surfaces of coins mapped in the r-θ coordinate system and stored therein and outputs it to the first discriminating means 34.

Figure 9:
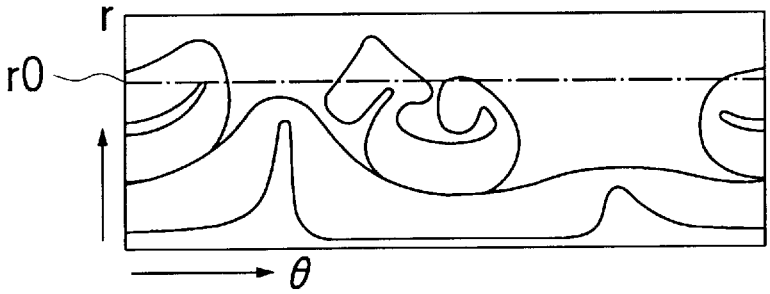
FIG. 9 is a view showing reference pattern data of the coin shown in FIG. 7.

FIG. 9 shows the reference pattern data of the reverse surface of the coin 1 shown in FIG. 7 and mapped in the r-θ coordinate system. This data corresponds to the converted pattern data of the lower surface of the coin 1 shown in FIG. 8. Since the converted pattern data shown in FIG. 8 is obtained in the pattern data converting means 32 by transforming the pattern data in the x-y coordinate system into the r-θ coordinate system based on the center coordinates (xc, yc) of the pattern data of the lower surface of the coin 1 determined by the center coordinate determining means 31, the zero point of the ordinate, namely, the zero point of the r-axis coincides with the zero point of the reference pattern data shown in FIG. 9. However, since the orientation of the coin 1 to be discriminated is usually offset angularly (rotationally) from that of the coin 1 used for producing the reference pattern data, the pattern data at the same θ value in FIGS. 8 and 9 are normally obtained from different portions of the coin 1. Accordingly, it is impossible to discriminate the denomination of the coin 1, its genuineness and the like by directly comparing the converted pattern data in FIG. 8 and the reference pattern data in FIG. 9 and, therefore, it is necessary to correct the converted pattern data prior to the comparison so that the zero point of the converted pattern data in the θ axis coincides with the zero point of the reference pattern data in the θ axis.

In view of the above, the first discriminating means 34 reads the pattern data values at a predetermined distance r0 from the data center of the converted pattern data of the lower surface of the coin 1 shown in FIG. 8, namely, reads the pattern data values whose ordinate values are equal to a predetermined value r0 over 360 degrees, and reads the pattern data values at a predetermined distance r0 from the data center of the reference pattern data of the reverse surface of the coin 1 shown in FIG. 9, namely, reads the pattern data values whose ordinate values are equal to a predetermined value r0 over 360 degrees. Then, the first discriminating means 34 compares the two sets of pattern data values, thereby correcting the deviation of the converted pattern data in the θ axis caused by the angular offset of the coin 1.

Figure 10:
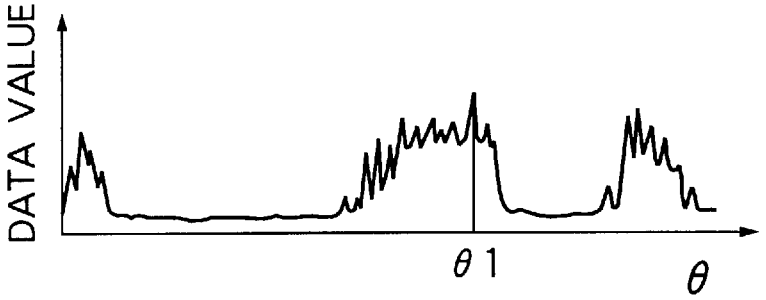
FIG. 10 is a graph showing pattern data values obtained by reading the converted pattern data shown in FIG. 8 over 360 degrees at a predetermined distance r0 from a data center.
Figure 11:
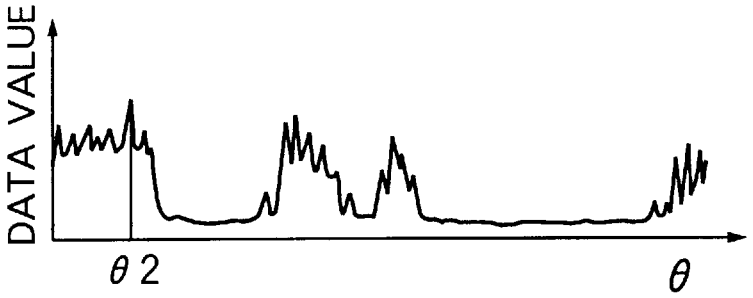
FIG. 11 is a graph showing pattern data values obtained by reading reference pattern data shown in FIG. 9 over 360 degrees at a predetermined distance r0 from the data center.

FIG. 10 is a graph showing pattern data values obtained by reading the converted pattern data shown in FIG. 8 over 360 degrees at a predetermined distance r0 from the data center and FIG. 11 is a graph showing pattern data values obtained by reading reference pattern data shown in FIG. 9 over 360 degrees at a predetermined distance r0 from the data center. In FIGS. 10 and 11, the ordinate represents data values and the abscissa represents the angle θ.

Coins 1 are fed through the coin passage 3 guided by the pair of guide rails 4 and, therefore, the center of the coin 1 passes along a predetermined locus on the transparent member 5. On the contrary, the coin 1 is usually offset angularly from the coin used to produce the reference pattern data. Therefore, since the sets of pattern data at the same θ value in FIGS. 8 and 9 are normally obtained from different portions of the coin 1, it is necessary to correct the converted pattern data prior to the comparison so that the zero point of the converted pattern data in the θ axis coincides with the zero point of the reference pattern data in the θ axis.

Figure 12:
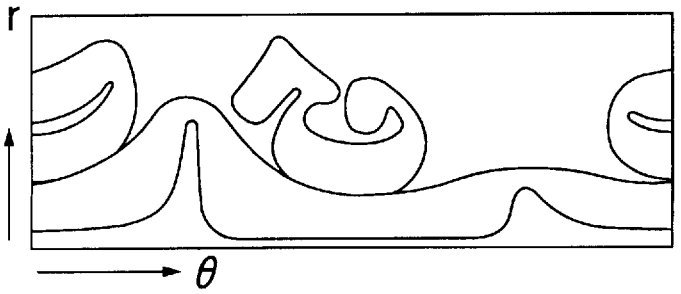
FIG. 12 is a view showing converted pattern data after remapping.

Accordingly, the first discriminating means 34 obtains θ values θ1 and θ2 at which the pattern data value shown in FIG. 10 and the pattern data value shown in FIG. 11 are maximum respectively and remaps the converted pattern data shown in FIG. 8 so that θ1 becomes equal to θ2. FIG. 12 shows the thus remapped converted pattern data.

The first discriminating means 34 compares the converted pattern data of the lower surface of the coin 1 remapped in the above described manner and shown in FIG. 12 with the reference pattern data of the reverse surface of the coin 1 shown in FIG. 11 and discriminates the denomination of the coin 1, its genuineness and whether or not it is a foreign coin, in accordance with the extent of how well the converted pattern data coincides with the reference pattern data. The result of discrimination made by the first discriminating means 34 is output to the coin discriminating means 25.

Figure 13:
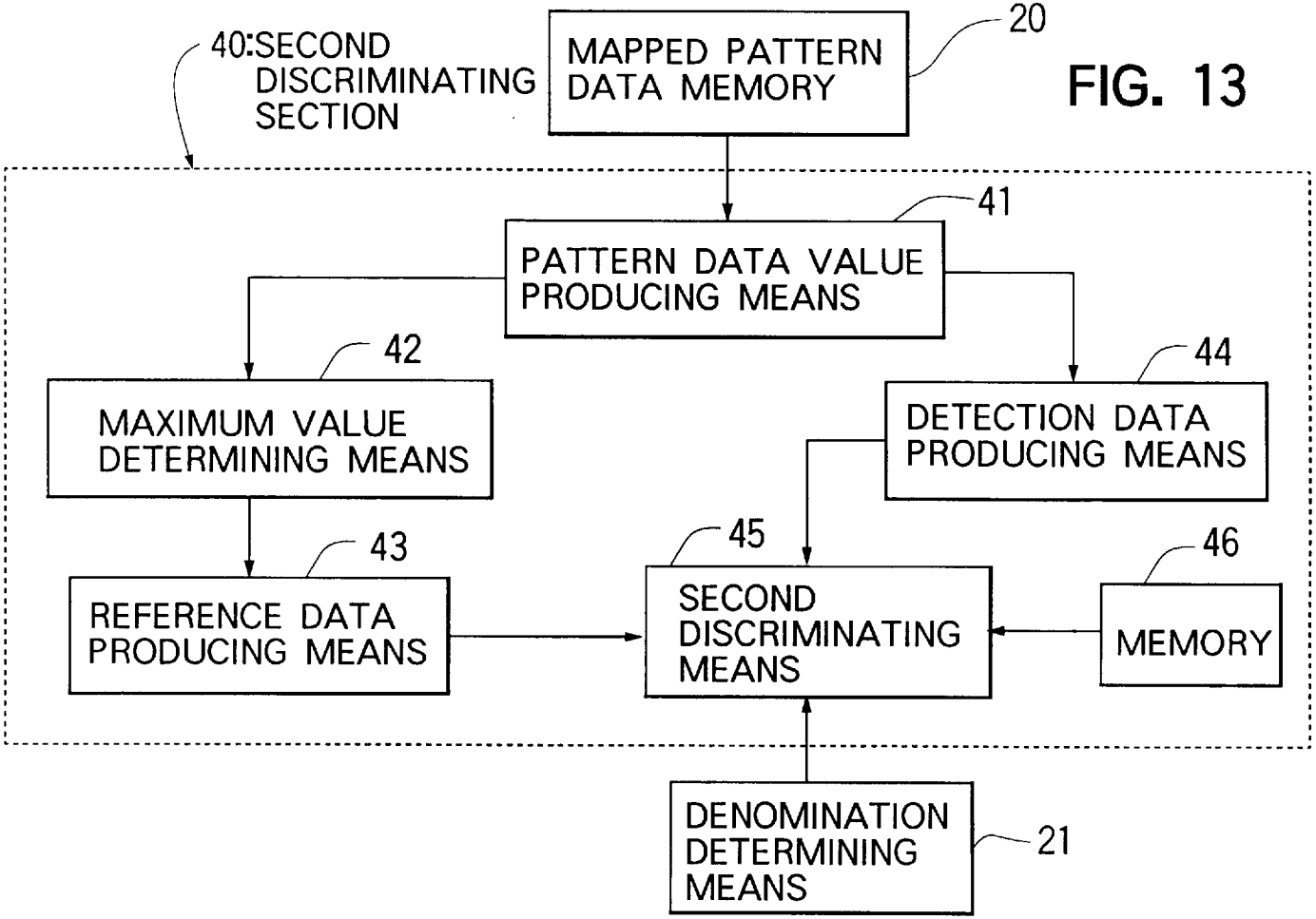
FIG. 13 is a block diagram of a second discriminating section.

FIG. 13 is a block diagram of the second discriminating section 40.

As shown in FIG. 13, the second discriminating section 40 includes pattern data value producing means 41 for producing pattern data values of the side surface of the coin 1 by determining coordinates x3 and x4 of boundary data c1 and c2 whose y coordinate is y3 of the pattern data of the side surface of the coin 1 mapped and stored in the mapped pattern data memory 20 and reading the pattern data between c1 (x3, y3) and c2 (x4, y3), maximum value determining means 42 for determining the maximum pattern data value based on the pattern data values produced by the pattern data value producing means 41, reference data producing means 43 for producing reference data based on the maximum pattern data value Pmax determined by the maximum value determining means 42 and the x-coordinates x3 and x4 of the boundary data c1 and c2, detection data producing means 44 for producing detection data by calculating an integral value of the pattern data values between the boundary data c1 and c2 based on the pattern data values produced by the pattern data value producing means 41, a second discriminating means 45 for discriminating the denomination of the coin 1, its genuineness and whether or not it is a foreign coin by comparing the reference data produced by the reference data producing means 43 and the detection data produced by the detection data producing means 44, and a memory 46.

In FIG. 6, the pattern data of the side surface of the coin 1 produced by the area sensor 11 are mapped in a x-y coordinate system and stored in the mapped pattern data memory 20 and the pattern data value producing means 41 determines x-coordinates x3 and x4 of boundary data c1 and c2 whose y coordinate is y3. The pattern data value producing means 41 then reads the pattern data between c1 (x3, y3) and c2 (x4, y3) and produces the pattern data values of the side surface of the coin 1. The thus produced pattern data value are output to the maximum value determining means 42 and the detection data producing means 44.

Figure 14A:
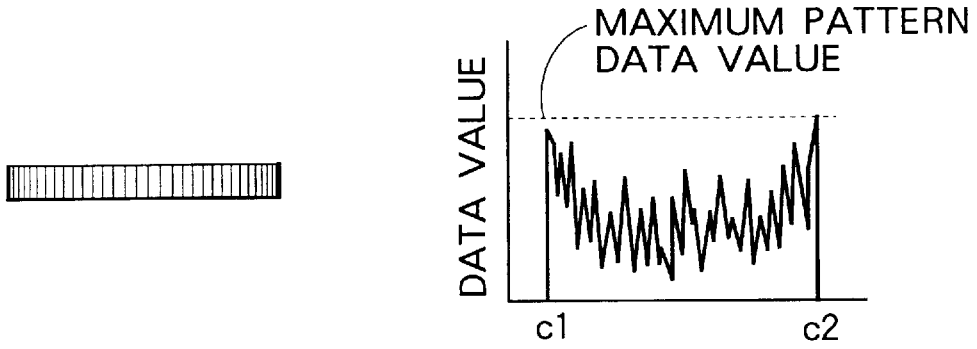
FIGS. 14*a*, 14*b* and 14*c* are graphs showing pattern data values obtained by reading pattern data of the side surface of a coin.
Figure 14B:
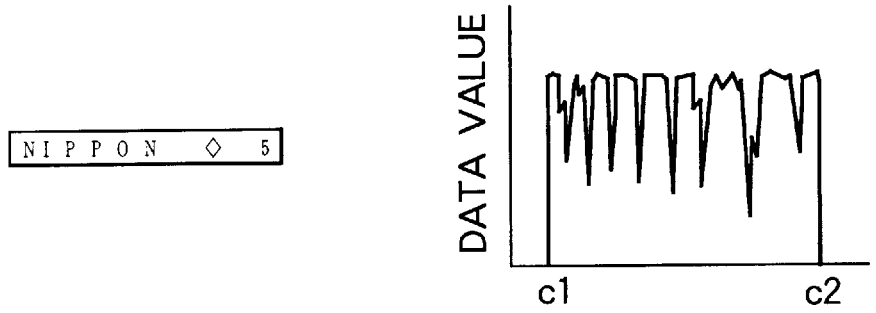
Figure 14C:
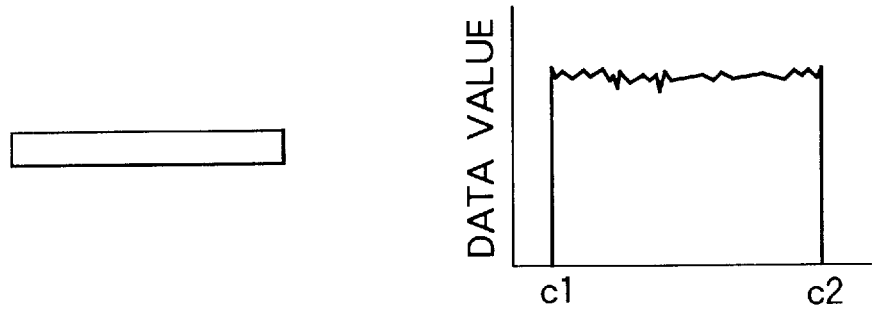

FIG. 14 is a set of graphs showing the pattern data values obtained by reading pattern data of the side surface of the coin 1. FIG. 14 (*a*) is a graph showing the pattern data obtained by reading the side surface of the coin 1 whose side surface is formed with a number of grooves in the direction perpendicular to the obverse and reverse surfaces thereof. FIG. 14 (*b*) is a graph showing the pattern data obtained by reading the side surface of the coin 1 whose side surface is inscribed with characters and the like. FIG. 14 (*c*) is a graph showing the pattern data obtained by reading the side surface of the coin 1 whose side surface is flat.

The maximum value determining means 42 determines the maximum pattern data value Pmax based on the pattern data values input from the pattern data value producing means 41 and outputs it to the reference data producing means 43.

The reference data producing means 43 produces the reference data R based on the maximum pattern data value Pmax input from the maximum value determining means 42 and the x-coordinates x3 and x4 of the boundary data c1 and c2 input from the pattern data value producing means 41 in accordance with the following formula and outputs it to the second discriminating means 45.

$$R=Pmax\times|x3-x4|$$

The detection data producing means 44 calculates an integral value of the pattern data values between the boundary data c1 and c2 based on the pattern data values of the side surface of the coin 1 input from the pattern data value producing means 41 to produce the detection data and outputs them to the second discriminating means 45.

A denomination signal has been input from the denomination determining means 21 to the second discriminating means 45 and in accordance with the denomination signal, the second discriminating means 45 reads the reference ratio D0/R0 of the detection data D0 and the reference data R0 of the denomination tentatively determined by the denomination determining means 21 and stored in the memory 46. The second discriminating means 45 then produces the ratio D/R of the detection data D input from the detection data producing means 44 and the reference data R input from the reference data producing means 43, compares it with the reference ratio D0/R0 read from the memory 46 and discriminates the denomination of the coin 1, its genuineness and whether or not it is a foreign coin, in accordance with how well the ratio D/R agrees with the reference ratio D0/R0. The result of discrimination made by the second discriminating means 45 is output to the coin discriminating means 25.

The thus constituted coin discriminating apparatus which is an embodiment of the present invention discriminates coins in the following manner.

First, when a coin 1 is fed through the coin passage 3 and the coin sensor 13 detects that the coin 1 reaches a prescribed position on the support plate 6, light is projected onto the lower surface of the coin 1 from the plurality of light emitting elements 8. The emitted light is reflected by the lower surface of the coin 1 and is focused by the convex lens 12 to enter the area sensor 11. Since the plurality of light emitting elements 8 are arranged in the transparent support plate 6 and the hole 7 of the support plate 6 is arranged immediately below the coin 1 to be discriminated such that the circumferential surfaces thereof are positioned outside of the coin 1 to be discriminated, light is projected onto the lower surface of the coin 1 at a shallow angle with respect to the lower surface of the coin 1 and light is reflected by the lower surface of the coin 1 in accordance with the surface irregularities constituting the pattern thereof and is received by the area sensor 11.

On the other hand, light impinging on the reflecting surface 10*a* of the mirror 10 among light reflected by the side surface of the coin 1 is reflected by the reflecting surface 10*a* of the mirror 10 to be directed to the area sensor 11 and is converged by the convex lens 12 to be received by the area sensor 11.

The area sensor 11 produces pattern data in accordance with the intensity of received light, namely, the pattern irregularities of the lower and side surfaces of the coin 1. Since the reflection members 9 are provided on the inner surfaces of side portions and upper and lower inner surfaces of the support plate 6, light is uniformly emitted from the transparent support plate 6 with uniform intensity and reflected by the lower and side surfaces of the coin 1. Therefore, if the denomination is the same, the same pattern data will be produced by the area sensor 11.

The pattern data of the lower and side surfaces of the coin 1 produced by the area sensor 11 are mapped in the x-y coordinate system and stored in the mapped pattern data memory 20. FIG. 7 shows one example of pattern data of the lower and side surfaces of the coin 1 produced by the area sensor 11 and mapped and stored in the mapped pattern data memory 20.

The denomination determining means 21 calculates the outer diameter of the coin 1 based on the pattern data of the lower surface of the coin 1 mapped in the x-y coordinate system and stored in the mapped pattern data memory 20 and tentatively determines the denomination of the coin 1, thereby producing a denomination signal and outputting it to the reference pattern data storing means 33.

On the other hand, the center coordinate determining means 31 of the first discriminating section 30 determines the center coordinates (xc, yc) of the pattern data of the coin 1 based upon the pattern data of the lower surface of the coin 1 mapped in the x-y coordinate system and stored in the mapped pattern data memory 20 and outputs it to the pattern data converting means 32.

Based on the center coordinates (xc, yc) of the pattern data of the lower surface of the coin 1 input from the center coordinate determining means 31, the pattern data converting means 32 transforms the pattern data of the lower surface of the coin 1 mapped in the x-y coordinate system and stored in the mapped pattern data memory 20 into an r-θ coordinate system. FIG. 8 shows the converted pattern data thus transformed into the r-θ coordinate system.

Based upon the denomination signal input from the denomination determining means 21, the reference pattern data storing means 33 selects the reference pattern data of the reverse surface of the coin 1 corresponding to the denomination from among the reference pattern data mapped into the r-θ coordinate system and stored therein and outputs them to the first discriminating means 34. FIG. 9 shows one example of the reference pattern data of the reverse surface of the coin 1 output from the reference pattern data storing means 33 to the first discriminating means 34.

Since the pattern data cannot be produced by the area sensor 11 with the coin 1 in a predetermined angular orientation and the coin 1 is normally offset angularly from the coin 1 used for producing the reference pattern data of the reverse surface of the coin 1, as is clear from FIGS. 8 and 9, the converted pattern data of the lower surface of the coin 1 is normally offset along the abscissa, namely, the θ axis, with respect to the reference pattern data of the reverse surface of the coin 1. Therefore, it is necessary to correct the deviation of the converted pattern data in the θ direction and discriminate the coin 1 by comparing the converted pattern data of the lower surface of the coin 1 with the reference pattern data of the reverse surface of the coin 1.

Accordingly, the first discriminating means 34 reads the pattern data values of the converted pattern data of the lower surface of the coin 1 shown in FIG. 8 over 360 degrees whose ordinate values are equal to a predetermined value r0 and reads the pattern data values of the reference pattern data of the reverse surface of the coin 1 shown in FIG. 9 over 360 degrees whose ordinate values are equal to a predetermined value r0.

FIGS. 10 and 11 are graphs obtained by plotting the thus read converted pattern data values of the lower surface of the coin 1 and reference pattern data values of the reverse surface of the coin 1 whose ordinate values are equal to a predetermined value r0. The first discriminating means 34 further calculates θ values at which the converted pattern data values of the lower surface of the coin 1 and the reference pattern data values of the reverse surface of the coin 1 become maximum respectively. The thus obtained θ value is θ1 in FIG. 10 and the θ value is θ2 in FIG. 11.

When θ1 and θ2 are obtained in this manner, the first discriminating means 34 remaps the converted pattern data of the lower surface of the coin 1 so that θ1 becomes equal to θ2. FIG. 12 shows an example of the converted pattern data of the lower surface of the coin 1 thus remapped by the first discriminating means 34. Since the deviation of the converted pattern data of the lower surface of the coin 1 in the θ direction caused by the angular offset of the coin 1 has been corrected by remapping the converted pattern data, it is possible for the first discriminating means 34 to discriminate whether the denomination of the coin 1 coincides with that tentatively determined by the denomination determining means 21, its genuineness and whether or not it is a foreign coin by pattern matching the converted pattern data with the reference pattern data of the reverse surface of the coin 1.

However, since it is impossible to feed the coin 1 so that one surface thereof always faces upward, if the coin is fed in such a manner that the reverse surface faces upward, the remapped converted pattern data never coincides with the reference pattern data of the reverse surface of the coin 1 of the denomination tentatively determined by the denomination determining means 21. Therefore, when the remapped converted pattern data of the lower surface of the coin 1 does not coincides with the reference pattern data of the reverse surface of the coin 1 of the denomination selected in accordance with the denomination signal input from the denomination determining means 21, if the coin 1 is immediately discriminated as a counterfeit coin or a foreign coin, the coin discrimination accuracy becomes lowered.

Accordingly, in this embodiment, the converted pattern data of the lower surface of the coin 1 is first compared with the reference pattern data of the reverse surface of the coin 1 of the denomination tentatively determined by the denomination determining means 21 and if they do not coincide, the converted pattern data of the lower surface of the coin 1 are compared with the reference pattern data of the obverse surface of the coin 1 of the denomination in the same manner, thereby discriminating whether the denomination of the coin 1 coincides with that tentatively determined by the denomination determining means 21, its genuineness and whether or not it is a foreign coin.

On the other hand, the pattern data value producing means 41 of the second discriminating section 40 determines coordinates x3 and x4 of boundary data c1 and c2 whose y coordinate is y3 of the pattern data of the side surface of the coin 1 mapped and stored in the mapped pattern data memory 20. The pattern data value producing means 41 then reads the pattern data between c1 (x3, y3) and c2 (x4, y3) and produces pattern data values of the side surface of the coin 1 to output them to the maximum value determining means 42 and the detection data producing means 44.

Each graph in FIG. 14 shows one example of the pattern data value obtained by reading the pattern data of the side surface of a coin 1. Although FIG. 14 (*c*) is a graph showing the pattern data values obtained by reading the pattern data of the side surface of the coin 1 whose side surface is flat, the pattern data values are not constant because of detection error.

The maximum value determining means 42 determines the maximum pattern data value P max based on the pattern data values input from the pattern data value producing means 41 and outputs it to the reference data producing means 43.

The reference data producing means 43 produces reference data based on the maximum pattern data value Pmax input from the maximum value determining means 42 and the x-coordinates x3 and x4 of the boundary data c1 and c2 input from the pattern data value producing means 41 in accordance with the following formula.

$$R=Pmax\times|x3-x4|$$

The detection data producing means 44 calculates an integral value of the pattern data values between the boundary data c1 and c2 based on the pattern data values of the side surface of the coin 1 input from the pattern data value producing means 41 to produce the detection data D and outputs them to the second discriminating means 45.

The second discriminating means 45 reads the reference ratio D0/R0 of the detection data D0 and the reference data of the denomination tentatively determined by the denomination determining means 21 and stored in the memory 46 in accordance with the denomination signal input from the denomination determining means 21. The second discriminating means 45 then produces the ratio D/R of the detection data D input from the detection data producing means 44 and the reference data R input from the reference data producing means 43, compares it with the reference ratio D0/R0 read from the memory 46 and discriminates the denomination of the coin 1, its genuineness and whether or not it is a foreign coin, in accordance with how well the ratio D/R agrees with the reference ratio D0/R0. The result of discrimination made by the second discriminating means 45 is output to the coin discriminating means 25.

Based on the results of discrimination made by the first discriminating means 34 and the second discriminating means 45, the coin discriminating means 25 discriminates that the coin 1 is a genuine coin only when the denomination of the coin 1 discriminated by the first discriminating means 34 coincides with that discriminated by the second discriminating means 45 and discriminates that the coin 1 is a counterfeit coin or a foreign coin, i. e. an unacceptable coin, when the results of discrimination made by the first discriminating means 34 and the second discriminating means 45 do not agree with each other.

According to the above described embodiment, a single area sensor 11 detects a pattern of the obverse or reverse surface and a pattern of the side surface of the coin 1 by providing a mirror 10 to produce pattern data of the obverse or reverse surface and the side surface of the coin 1 and the coin 1 is discriminated using the pattern data of the obverse or reverse surface and the side surface of the coin 1. Therefore, it is possible to improve the accuracy of discriminating coins 1 with a simple structure. Further, since the deviation of the converted pattern data in the direction caused by the angular offset of the coin 1 can be corrected merely by obtaining the values θ1 and θ2 at which the respective data values of the converted pattern data and the reference pattern data become maximum and remapping the converted pattern data so that θ1 becomes equal to θ2, it is possible to shorten the time for calculation, whereby coins 1 can be discriminated at high speed.

Figure 15:
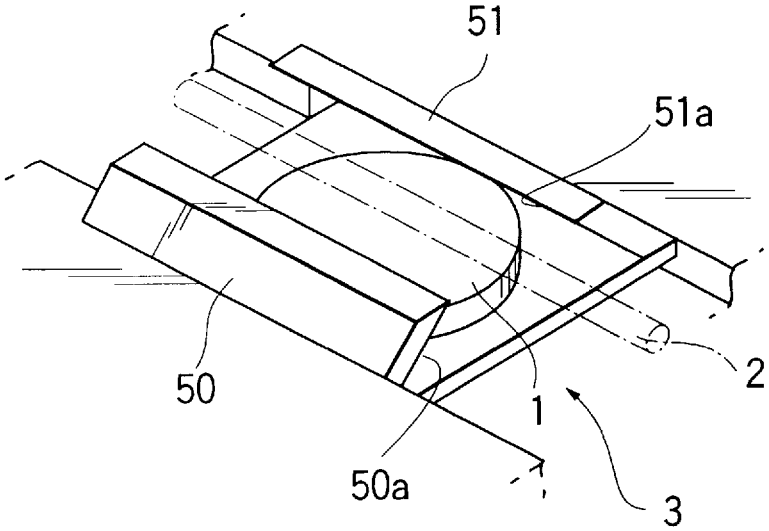
FIG. 15 is a schematic perspective view of a coin discriminating apparatus which is another embodiment of the present invention.

FIG. 15 is a schematic perspective view of a coin discriminating apparatus which is another embodiment of the present invention.

As shown in FIG. 15, the coin discriminating apparatus includes a pair of mirrors 50, 51. Each of the pair of mirrors 50, 51 is provided with a reflecting surface 50*a*, 51*a* and is located at a predetermined angle, for example, 45 degrees, with the axis of the coin 1 so that each of the reflecting surfaces 50*a*, 51*a* leads light reflected by the side surface of the coin 1 to the area sensor 11. Therefore, pattern data of both the side surfaces of the coin 1 are produced by the area sensor 11 and the coin 1 is discriminated by the second discriminating means 45 based on the pattern data of both the side surfaces of the coin 1.

According to the above described embodiment, even a coin 1 a part of the side surface of which is formed with a characteristic pattern can be accurately discriminated based on the pattern of the side surfaces of the coin 1.

Figure 16:
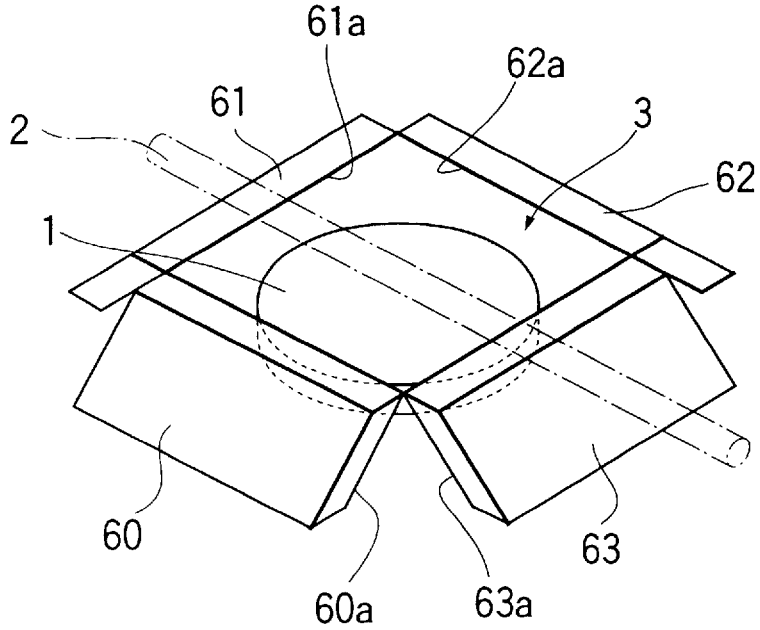
FIG. 16 is a schematic perspective view of a coin discriminating apparatus which is a further embodiment of the present invention.

FIG. 16 is a schematic perspective view of a coin discriminating apparatus which is a further embodiment of the present invention.

As shown in FIG. 16, the coin discriminating apparatus includes four mirrors 60, 61, 62, 63. In this embodiment, since coins 1 are transported across the lower portions of the mirrors 61, 63, the mirrors 60, 61, 62, 63 are located slightly higher than the mirrors in the previous embodiments so as not to interfere with coins being transported in the coin passage 3. Each of the mirrors 60, 61, 62, 63 is provided with a reflecting surface 60*a*, 61*a*, 62*a*, 63*a* and is located at a predetermined angle, for example, 45 degrees, with the axis of the coin 1 so that each of the reflecting surfaces 60*a*, 61*a*, 62*a*, 63*a* leads light reflected by the side surface of the coin 1 to the area sensor 11. Therefore, pattern data of four side surfaces of the coin 1 are produced by the area sensor 11 and the coin 1 is discriminated by the second discriminating means 45 based on the pattern data of four side surfaces of the coin 1.

According to the above described embodiment, even a coin 1 a part of the side surface of which is formed with a characteristic pattern can be more accurately discriminated based on the pattern of the side surfaces of the coin 1.

The present invention has thus been shown and described with reference to specific embodiments. However, it should be noted that the present invention is in no way limited to the details of the described arrangements but changes and modifications may be made without departing from the scope of the appended claims.

For example, in the above described embodiments, the mirrors 10, 50, 51, 60, 61, 62, 63 having flat reflecting surfaces 10*a*, 50*a*, 51*a*, 60*a*, 61*a*, 62*a*, 63*a* are used. However, it is possible to use other mirrors such as concave mirrors which can lead light reflected by the side surfaces of coins 1 to the area sensor 11.

Further, in the above described embodiments, the reference data R and the detection data D are produced based on the coordinate values x3 and x4 of the boundary data c1 and c2. However, since the plurality of light emitting elements 8 are annularly located around the coin 1 to be irradiated with light, the pattern data value of the boundary data c1 or c2 is highest and the pattern data values representing the characteristic pattern of the side surface of the coin 1 do not appear in the vicinity of the boundary data c1 and c2 but appear in the vicinity of a central portion of the pattern data. Therefore, after the pattern data values have been produced by reading the pattern data between c1 (x3, y3) and c2 (x4, y3) and the maximum pattern data value has been determined, reference data may be produced in accordance with the following formula and the pattern data values between coordinate values x5 and x6 (the coordinate values x5 and x6 are values between the coordinate values x3 and x4.) are integrated to produce detection data D.

$$R=Pmax\times|x5-x6|$$

Furthermore, in the above described embodiments, although the pattern data values of points whose y-coordinate values are equal to y3 are calculated among the pattern data of the side surface of the coin 1 to produce the reference data R and the detection data D, the pattern data values of the all patten data of the side surface of the coin 1 may be calculated to produce reference data R and detection data D.

Moreover, in the above described embodiments, although the second discriminating means 45 discriminates coins 1 based on the patterns of the side surfaces of coins 1, instead or in addition to this, it is possible for the second discriminating means 45 to discriminate coins 1 by detecting the thickness of coins 1 based on the pattern data of the side surfaces of coins 1.

Further, in the above described embodiments, although the area sensor 11 is used as a sensor for detecting light reflected by the lower surface of the coin 1, other types of sensors such as a line sensor may be used instead.

Moreover, in the above described embodiments, the light emitting elements 8 always emit light and the area sensor 11 receives the light reflected by the coin 1 positioned above the hole 8 and produces pattern data at a predetermined time determined by a coin detection signal output by the coin sensor 13 when it detects the coin 1. However, the coin sensor 13 may be caused to output a coin detection signal to means for controlling the light emitting elements 8 when it detects a coin 1, thereby causing the light emitting elements 8 to emit light at a predetermined time and the area sensor 11 to receive the light.

Furthermore, in the above described embodiments, although the reflection members 9 are provided on the inner surfaces of the side portions and the upper and lower inner surfaces of the support plate 6, the reflection members 9 may be provided at different portions depending upon the characteristics of the light emitting elements 8.

Further, in the embodiment shown in FIG. 16, although the coin discriminating apparatus includes four mirrors 60, 61, 62, 63, since the pattern of the side surface of a coin 1 can be detected if three mirrors are provided, it is unnecessary to provide four mirrors and the provision of at least three mirrors is sufficient.

Furthermore, in the above described embodiments, the deviation of the converted pattern data caused by the angular offset of the coin 1 is corrected by obtaining the θ values θ1 and θ2 at which the data values of the converted pattern data of the lower surface of the coin 1 and the reference pattern data whose ordinate values are equal to r0 become maximum and remapping the converted pattern data so that θ1 becomes equal to θ2. However, depending upon the kind of coins, the data values of the reference pattern data whose ordinate values are equal to a predetermined value r0 may have the maximum value plus a plurality of values whose magnitudes are close to the maximum value. In such a case, the first discriminating means 34 may make erroneous judgment because a data value which is not maximum was mistakenly detected as the maximum value, in which case the deviation of the converted pattern data in the direction caused by the angular offset of the coin 1 will not be corrected even if the converted pattern data of the lower surface of the coin 1 are remapped. As a result, the coin will not be correctly discriminated. For preventing such erroneous discrimination, it is possible to discriminate the coin 1 by remapping the converted pattern data of the lower surface of the coin 1 No times (No being an integer not smaller than 2) based on the data values in order from greater data value to smaller data value.

Further, in the above described embodiments, instead of obtaining θ values θ1 and θ2 at which the data values of the converted pattern data of the lower surface of the coin 1 and the reference pattern data whose ordinate values are equal to r0 become maximum, the square of the difference between the data values of the converted pattern data and the reference pattern data whose ordinate values are equal to a predetermined value r0 can be integrated over the range from 0 to 360 degrees of the θ value to obtain an integrated value and the graph of the data values of the converted pattern data shown in FIG. 10 be moved in parallel with the θ axis. When the thus calculated integrated value becomes minimum, it can be judged that the deviation of the converted pattern data caused by the angular offset of the coin 1 is corrected and the converted pattern data of the lower surface of the coin 1 can be remapped to be compared with the reference data, thereby discriminating the coin 1. Moreover, the difference between the data values of the converted pattern data and the reference pattern data whose ordinate values are equal to a predetermined value r0 can be integrated over the range from 0 to 360 degrees of the θ value to obtain an integrated value and the graph of the data values of the converted pattern data of the lower surface of the coin 1 shown in FIG. 10 be moved in parallel with the θ axis. When the thus calculated integrated value becomes minimum, it can be judged that the deviation of the converted pattern data caused by the angular offset of the coin 1 is corrected and the converted pattern data of the lower surface of the coin 1 can be remapped to be compare with the reference data, thereby discriminating the coin 1.

Furthermore, in the above described embodiments, the converted pattern data of the lower surface of the coin 1 is first compared with the reference pattern data of the reverse surface of the coin 1 of the denomination tentatively determined by the denomination determining means 21 and if they do not coincide, the converted pattern data of the lower surface of the coin 1 is compared with the reference pattern data of the obverse surface of the coin 1 of the denomination in the same manner, thereby discriminating whether the denomination of the coin 1 coincides with that tentatively determined by the denomination determining means 21, its genuineness and whether or not it is a foreign coin. However, the converted pattern data of the lower surface of the coin 1 can be first compared with the reference pattern data of the obverse surface of the coin 1 of the denomination tentatively determined by the denomination determining means 21 and if they do not coincide, the converted pattern data can be compared with the reference pattern data of the reverse surface of the coin 1 of the denomination in the same manner, thereby discriminating whether the denomination of the coin 1 coincides with that tentatively determined by the denomination determining means 21, its genuineness and whether or not it is a foreign coin.

Further, in this specification and the appended claims, the respective means need not necessarily be physical means and arrangements whereby the functions of the respective means are accomplished by software fall within the scope of the present invention. In addition, the function of a single means may be accomplished by two or more physical means and the functions of two or more means may be accomplished by a single physical means.

According to the present invention, it is possible to provide a compact coin discriminating apparatus capable of discriminating coins by optically detecting the pattern of the obverse or reverse surface and the side surface of a coin with simple structure and with high accuracy.

I claim:

1. A coin discriminating apparatus comprising irradiating means for projecting light onto a coin, light receiving means for optically detecting light reflected by the coin and producing pattern data of the coin, a mirror member provided on one side portion of the coin along the coin passage at a predetermined angle with an axis of the coin for reflecting light reflected from a side surface of the coin and leading the light to the light receiving means, and a coin discriminating means for discriminating the coin based on first pattern data produced by detecting light reflected from a lower surface of the coin and second pattern data produced by detecting light reflected by the side surface of the coin.

2. A coin discriminating apparatus in accordance with claim 1 wherein the coin discriminating means comprises first coin discriminating means for discriminating a coin based on the first pattern data produced by detecting light reflected from the lower surface of the coin, second coin discriminating means for discriminating the coin based on the second pattern data produced by detecting light reflected by the side surface of the coin, and third coin discriminating means for discriminating the coin to be an unacceptable coin when the results of the discrimination by the first coin discriminating means and the second coin discriminating means does not agree with each other and discriminating the coin to be a genuine coin of a denomination discriminated by the first coin discriminating means and the second coin discriminating means when the results of the discrimination by the first coin discriminating means and the second coin discriminating means agree with each other.

3. A coin discriminating apparatus in accordance with claim 2 wherein the second coin discriminating means is constituted so as to discriminate a coin further from thickness of the coin calculated based on the second pattern data.

4. A coin discriminating apparatus in accordance with claim 1 wherein the irradiating means comprises light emitting means for emitting light and light directing means for uniformly directing light emitted from the light emitting means onto the surface of the coin at a shallow angle.

5. A coin discriminating apparatus in accordance with claim 2 wherein the irradiating means comprises light emitting means for emitting light and light directing means for uniformly directing light emitted from the light emitting means onto the surface of the coin at a shallow angle.

6. A coin discriminating apparatus in accordance with claim 3 wherein the irradiating means comprises light emitting means for emitting light and light directing means for uniformly directing light emitted from the light emitting means onto the surface of the coin at a shallow angle.

7. A coin discriminating apparatus comprising irradiating means for projecting light onto a coin, light receiving means for optically detecting light reflected by the coin and producing pattern data of the coin, a pair of mirror members provided on both side portions of the coin along the coin passage at predetermined angles with an axis of the coin for reflecting light reflected from a side surface of the coin and leading the light to the light receiving means, and a coin discriminating means for discriminating the coin based on first pattern data produced by detecting light reflected from a lower surface of the coin and second pattern data produced by detecting light reflected by the side surface of the coin.

8. A coin discriminating apparatus in accordance with claim 7 wherein the coin discriminating means comprises first coin discriminating means for discriminating a coin based on the first pattern data produced by detecting light reflected from the lower surface of the coin, second coin discriminating means for discriminating the coin based on the second pattern data produced by detecting light reflected by the side surface of the coin, and third coin discriminating means for discriminating the coin to be an unacceptable coin when the results of the discrimination by the first coin discriminating means and the second coin discriminating means does not agree with each other and discriminating the coin to be a genuine coin of a denomination discriminated by the first coin discriminating means and the second coin discriminating means when the results of the discrimination by the first coin discriminating means and the second coin discriminating means agree with each other.

9. A coin discriminating apparatus in accordance with claim 8 wherein the second coin discriminating means is constituted so as to discriminate a coin further from thickness of the coin calculated based on the second pattern data.

10. A coin discriminating apparatus in accordance with claim 7 wherein the irradiating means comprises light emitting means for emitting light and light directing means for uniformly directing light emitted from the light emitting means onto the surface of the coin at a shallow angle.

11. A coin discriminating apparatus in accordance with claim 8 wherein the irradiating means comprises light emitting means for emitting light and light directing means for uniformly directing light emitted from the light emitting means onto the surface of the coin at a shallow angle.

12. A coin discriminating apparatus in accordance with claim 9 wherein the irradiating means comprises light emitting means for emitting light and light directing means for uniformly directing light emitted from the light emitting means onto the surface of the coin at a shallow angle.

13. A coin discriminating apparatus comprising irradiating means for projecting light onto a coin, light receiving means for optically detecting light reflected by the coin and producing pattern data of the coin, at least three mirror members provided on side portions of the coin above the coin passage at predetermined angles with an axis of the coin for reflecting light reflected from a side surface of the coin and leading the light to the light receiving means, and a coin discriminating means for discriminating the coin based on first pattern data produced by detecting light reflected from a lower surface of the coin and second pattern data produced by detecting light reflected by the side surface of the coin.

14. A coin discriminating apparatus in accordance with claim 13 wherein the coin discriminating means comprises first coin discriminating means for discriminating a coin based on the first pattern data produced by detecting light reflected from the lower surface of the coin, second coin discriminating means for discriminating the coin based on the second pattern data produced by detecting light reflected by the side surface of the coin, and third coin discriminating means for discriminating the coin to be an unacceptable coin when the results of the discrimination by the first coin discriminating means and the second coin discriminating means does not agree with each other and discriminating the coin to be a genuine coin of a denomination discriminated by the first coin discriminating means and the second coin discriminating means when the results of the discrimination by the first coin discriminating means and the second coin discriminating means agree with each other.

15. A coin discriminating apparatus in accordance with claim 14 wherein the second coin discriminating means is constituted so as to discriminate a coin further from thickness of the coin calculated based on the second pattern data.

16. A coin discriminating apparatus in accordance with claim 13 wherein the irradiating means comprises light emitting means for emitting light and light directing means for uniformly directing light emitted from the light emitting means onto the surface of the coin at a shallow angle.

17. A coin discriminating apparatus in accordance with claim 14 wherein the irradiating means comprises light emitting means for emitting light and light directing means for uniformly directing light emitted from the light emitting means onto the surface of the coin at a shallow angle.

18. A coin discriminating apparatus in accordance with claim 15 wherein the irradiating means comprises light emitting means for emitting light and light directing means for uniformly directing light emitted from the light emitting means onto the surface of the coin at a shallow angle.

* * * * *